US009705182B2

(12) United States Patent
Hsu et al.

(10) Patent No.: US 9,705,182 B2
(45) Date of Patent: Jul. 11, 2017

(54) PATCH-BASED PROXIMITY SENSORS, ANTENNAS, AND CONTROL SYSTEMS TO CONTROL ANTENNAS BASED ON CORRESPONDING PROXIMITY MEASURES

(75) Inventors: Hao-Han Hsu, Portland, OR (US); Songnan Yang, San Jose, CA (US); Dong-Ho Han, Beaverton, OR (US); Chung-Hao J. Chen, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 1373 days.

(21) Appl. No.: 13/538,892

(22) Filed: Jun. 29, 2012

(65) Prior Publication Data

US 2014/0002305 A1 Jan. 2, 2014

(51) Int. Cl.

| | |
|---|---|
| ***H01Q 3/00*** | (2006.01) |
| ***H01Q 1/24*** | (2006.01) |
| ***H01Q 1/52*** | (2006.01) |
| ***H01Q 9/04*** | (2006.01) |

(52) U.S. Cl.

CPC ..... *H01Q 1/245* (2013.01); *H01Q 1/52* (2013.01); *H01Q 9/0407* (2013.01); *H01Q 9/0421* (2013.01)

(58) Field of Classification Search

CPC ..... H01Q 1/52; H01Q 1/245; H01Q 9/0407

USPC ..... 342/367, 368

See application file for complete search history.

(56) References Cited

U.S. PATENT DOCUMENTS

| | | | | |
|---|---|---|---|---|
| 6,930,639 | B2 * | 8/2005 | Bauregger | H01Q 1/38 343/700 MS |
| 6,985,113 | B2 * | 1/2006 | Nishimura | H01Q 1/245 343/700 MS |
| 7,146,139 | B2 | 12/2006 | Nevermann | |
| 7,554,496 | B2 | 6/2009 | Qi et al. | |
| 8,326,385 | B2 * | 12/2012 | Brogle | G01D 5/2405 455/522 |

(Continued)

FOREIGN PATENT DOCUMENTS

| | | | |
|---|---|---|---|
| KR | 10-2005-0024090 | A | 3/2005 |
| KR | 10-2007-0071549 | A | 7/2007 |

OTHER PUBLICATIONS

International Search Report and Written Opinion Received for PCT Patent application No. PCT/US2011/067928 mailed on Sep. 26, 2012, 9 pages.

*Primary Examiner* — Chuong P Nguyen

(74) *Attorney, Agent, or Firm* — Schwabe, Williamson & Wyatt, P.C.

(57) ABSTRACT

A patch-based proximity sensor having a capacitance and/or inductance that varies based on a proximity of an animate body, a sense circuit to sense the capacitance and/or inductance, and a control system to compare one or more sensed values to one or more thresholds, and to selectively enable/disable one or more antennas based on the comparison(s). The threshold may correspond to a desired/permitted minimum distance between an antenna and an animate body, and/or a desired/permitted maximum electromagnetic energy exposure to the animate body. A multi-layer module may include one or more patch-based proximity sensors and one or more patch-antennas. Multiple antennas may be individually controllable based on corresponding proximity measures.

12 Claims, 8 Drawing Sheets

View A

(56) References Cited

U.S. PATENT DOCUMENTS

| | | | | |
|---|---|---|---|---|
| 8,432,322 | B2 * | 4/2013 | Amm | H01Q 1/243 324/658 |
| 8,467,840 | B2 * | 6/2013 | Lin | H01Q 1/245 455/550.1 |
| 8,577,289 | B2 * | 11/2013 | Schlub | G01B 7/023 343/702 |
| 8,831,528 | B2 * | 9/2014 | Shi | H04B 1/3838 455/575.5 |
| 2004/0214621 | A1 | 10/2004 | Ponce De Leon et al. | |
| 2004/0248523 | A1 | 12/2004 | Nishimura et al. | |
| 2010/0279751 | A1 | 11/2010 | Pourseyed et al. | |
| 2011/0159920 | A1 * | 6/2011 | Lehmann | H04M 1/0202 455/556.1 |
| 2011/0250928 | A1 * | 10/2011 | Schlub | H01Q 1/243 455/550.1 |
| 2012/0052820 | A1 | 3/2012 | Lin et al. | |
| 2014/0269977 | A1 * | 9/2014 | Yang | H04B 1/3838 375/295 |
| 2014/0315606 | A1 * | 10/2014 | You | H04B 1/3838 455/575.5 |
| 2015/0188220 | A1 * | 7/2015 | Liou | H01Q 1/245 342/385 |
| 2015/0372371 | A1 * | 12/2015 | Lagnado | H01Q 1/22 343/720 |

* cited by examiner

PATCH-BASED PROXIMITY SENSORS, ANTENNAS, AND CONTROL SYSTEMS TO CONTROL ANTENNAS BASED ON CORRESPONDING PROXIMITY MEASURES

BACKGROUND

An animate body proximate to a radiating antenna may cause the antenna to suffer from de-tuning, increased return loss, and/or other performance degradation.

In addition, the animate body may be exposed to a radio frequency (RF) electromagnetic (EM) field of the antenna, which may impart potentially harmful RF EM energy or radiation to the animate body.

Specific absorption rate (SAR) is a measure of a rate at which energy is absorbed by an animate body when exposed to an RF EM field. SAR may be determined in terms of power absorbed per mass of tissue, such as watts per kilogram (W/kg). SAR may be measured and/or averaged over an entire body or a portion thereof.

The United States Federal Communications Commission (FCC) requires that all wireless communications devices sold in the United States, including portable devices, meet minimum guidelines for human exposure to RF energy. The FCC defines a portable device as "a transmitting device designed to be used so that the radiating structure(s) of the device is/are within 20 centimeters of the body of the user." (47 C.F.R. Ch. 1, §2.1093). For portable devices transmitting within a frequency range of 100 kHz to 6 GHz, the FCC provides the following SAR limits for general populations:

> 0.08 W/kg as averaged over the whole-body and spatial peak SAR not exceeding 1.6 W/kg as averaged over any 1 gram of tissue (defined as a tissue volume in the shape of a cube). Exceptions are the hands, wrists, feet and ankles where the spatial peak SAR shall not exceed 4 W/kg, as averaged over any 10 grams of tissue (defined as a tissue volume in the shape of a cube).

(47 C.F.R. Ch. 1, §2.1093(2))

SAR varies based on a distance between an antenna and an animate body. In a portable device, such as a tablet or ultra-book, a user may frequently be within centimeters (cm) or even millimeters (mm) a device antenna, which may hamper or preclude government approval of such devices.

A portable communication device may include an omni-directional or isotropic antenna, such as a planar inverted F antenna (PIFA). The portable communication device may further include a dynamic power reduction (DPR) system to reduce transmit power to a pre-defined lower power level if an animate body is detected proximate to the antenna. In other words, a conventional DPR reduces transmit power in all-directions regardless of the location of a detected body. This may unnecessarily hinder wireless communication. Conventional DPRs also include discrete proximity sensors that occupy relatively considerable space and adversely impact antenna performance, such as when a proximity sensor is within a radiation beam or pattern of the antenna.

Figure 1:
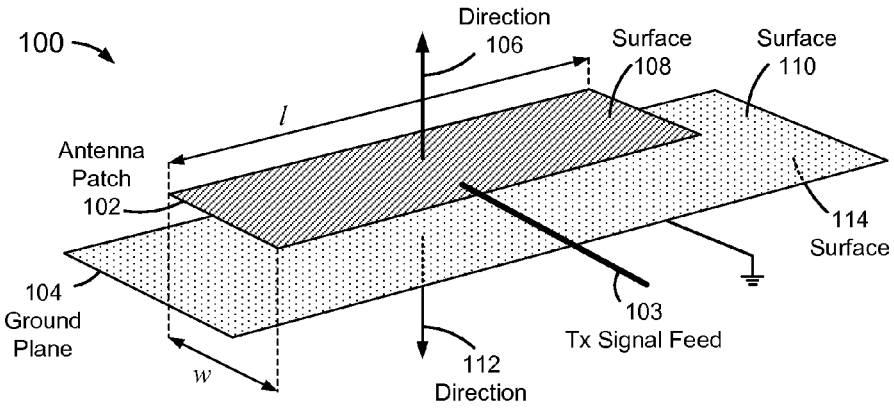
FIG. 1 is a perspective view of a patch antenna.

In the drawings, the leftmost digit(s) of a reference number identifies the drawing in which the reference number first appears.

DETAILED DESCRIPTION

Disclosed herein is a passive, directional, patch-based proximity sensor having one or more of a capacitance and an inductance configured to vary based on a proximity of an animate body to the sensor. A patch-based proximity sensor occupies relatively little space, and may be configured to detect an animate body proximate to an antenna with little or no impact on antenna performance.

Also disclosed herein are multi-layer modules or packages of one or more patch-based proximity sensors and one or more patch antennas. A separate feed line may be provided to each of multiple sets of one or more antennas to permit selective use of the antennas based on one or more measures of proximity. Multiple antennas set may be configured to radiate in multiple corresponding directions, such as to provide configurable radiation patterns or configurable directionality.

Also disclosed herein are control systems to sense and/or monitor patch-based proximity sensors, and to selectively control one or more antennas based on the monitoring.

A control system as disclosed herein may be configured to redirect EM energy from one direction to another direction to reduce and/or eliminate EM energy exposure to the animate body.

FIG. 1 is a perspective view of an antenna 100, including an electrically conductive portion or patch 102 and a ground plane 104, to transmit a signal received through a feed 103. The transmit signal may include a radio frequency (RF) signal, and antenna 100 may be configured to transmit the RF signal as electromagnetic (EM) radiation at the radio frequency.

Patch 102 may have a length l of approximately ½ of a wavelength of a center frequency of the transmit signal, and a width w of approximately ¼ of a wavelength of the center frequency. The center frequency may be, for example, approximately 2.5 giga Hertz (GHz).

In the example of FIG. 1, patch 102 has a rectangular shape. Patch 102 is not, however, limited to rectangular shapes and may include, for example, one or more of arcuate, slotted, and/or oval features. A surface area of ground plane 104 may be greater than a surface area of patch 102.

Antenna 100 may be configured to radiate outwardly from a first side, or a radiate side of antenna 100, corresponding to a side or surface 108 of patch 102 and/or a side or surface 110 of ground plane 104. Antenna 100 may be configured to radiate in a substantially semi-spherical radiation pattern, which may directed approximately in a direction 106, and bounded by ground plane 104. Ground plane 104 may substantially preclude antenna 100 from radiating from one or more other sides of antenna 100, or in one or more other directions. Antenna 100 may be referred to herein as a directional patch antenna.

Ground plane 104 may also substantially shield antenna 100 from effects of an animate body that approaches antenna 100 from other than the radiate side of antenna 100. The may protect antenna 100 from de-tuning, increased return loss and/or other performance degradation when an animate body is proximate one or more other sides of antenna 100.

Patch 102 may be in a first plane and ground plane 104 may be in a second plane. The first and second planes may be parallel with one another.

Antenna 100 may include a dielectric material between patch 102 and ground plane 104. The dielectric material may have a thickness of, for example, approximately 2 to 5 millimeters (mm), measured between patch 102 and ground plane 104. Antenna 100 is not, however, limited to this example. The dielectric material may include one or more layers of a printed circuit board (PCB) material, such as an FR-4 grade of a glass-reinforced epoxy laminate material. Antenna 100 may be constructed, manufactured, or fabricated with a PCB manufacturing/fabrication technique.

An apparatus or system may include multiple patch antennas, such as described below with reference to FIG. 2.

Figure 2:
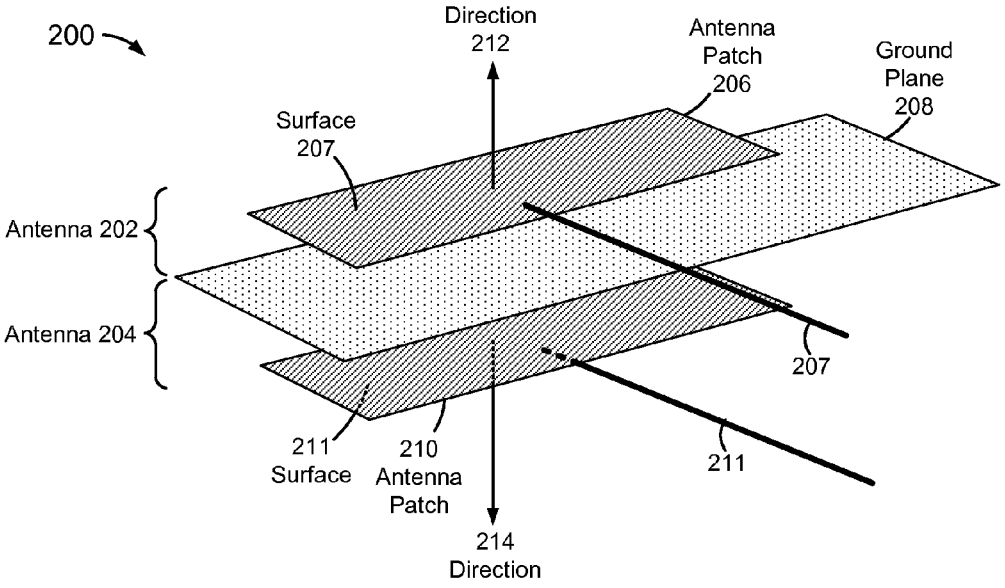
FIG. 2 is a perspective view of an apparatus that includes multiple patch antennas.

FIG. 2 is a perspective view of an antenna apparatus 200, including a first antenna 202 and a second antenna 204. First antenna 202 includes a first patch 206 and a ground plane 208 to transmit a signal received over a feed 207, such as described above with reference to FIG. 1. Second antenna 204 includes a second patch 210 and ground plane 208, to transmit a signal received over a feed 211. Feeds 207 and 211 may provide the same transmit signal(s) to antennas 202 and 207, and/or different transmit signal(s).

In FIG. 2, ground plane 208 is shared by antennas 202 and 204. Alternatively, antennas 202 and 204 may each include a corresponding ground plane.

In FIG. 2, Patch 206 is in a first plane, second patch 210 is in a second plane, and ground plane 208 is between the first and second planes. Two or more of the first and second planes and ground plane 208 may be parallel with one another. Methods and system disclosed herein are not, however, limited to these examples.

Apparatus 200 may include a dielectric material between first patch 206 and ground plane 208, and between second patch 210 and ground plane 208, such as described above with reference to FIG. 1.

First antenna 202 may be configured to radiate outwardly from a side or surface 207 of patch 206, substantially in a direction 212, such as described above with reference to FIG. 1. Second antenna 204 may be configured to radiate outwardly from a side or surface 211 of patch 210, substantially in a direction 214.

First and second directions 212 and 214 may differ from one another. In the example of FIG. 2, first and second directions 212 and 214 are illustrated as substantially opposite of one another. Methods and systems disclosed herein are not, however, limited to this example.

A surface area of ground plane 208 may be greater than an area of patch 206 and an area of patch 210.

Ground plane 208 may substantially preclude antenna 202 from radiating in direction 214, such as described above with reference to FIG. 1. Similarly, ground plane 208 may substantially preclude antenna 204 from radiating in direction 212.

Ground plane 208 may shield first antenna 202 from effects of an animate body that approaches apparatus 200 in direction 212 towards side 211 of patch 210. Similarly, ground plane 208 may shield second antenna 204 from effects of an animate body that approaches apparatus 200 in direction 214 towards side 207 of patch 206.

Antennas 202 and 204 may each be configured to radiate with a substantially semi-spherical radiation pattern, each bounded by ground plane 208, and may provide a combined radiation pattern that is substantially isotropic, or near-isotropic.

Patches 206 and 210 may have dimensions that are similar to, and/or identical to one another.

Patches 206 and 210 may be aligned relative to one another. For example, a center of patch 206 may be aligned with a center of patch 210.

Figure 3:
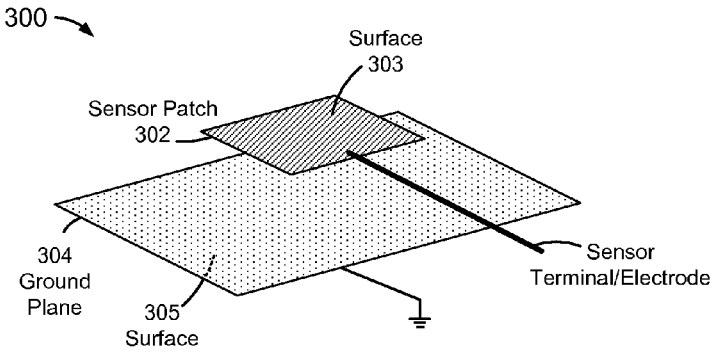
FIG. 3 is a perspective view of patch-based proximity sensor.

FIG. 3 is a perspective view of a patch-based proximity sensor 300, including an electrically conductive sensor patch 302 and a ground plane 304.

In the example of FIG. 3, sensor patch 302 has a rectangular shape. Sensor patch 302 is not, however, limited to rectangular shapes and may include, for example, one or more of arcuate, slotted, and/or oval features. A surface area of ground plane 304 may be greater than a surface area of sensor patch 302.

Sensor 300 may include a dielectric material between patch 302 and ground plane 304, such as described above with reference to FIG. 1.

An animate body proximate to sensor 300 may impart a load to sensor 300, which may include a capacitive and/or inductive load. A human body, for example, has a relatively high dielectric constant. A capacitance of sensor 300 may thus increase somewhat substantially as a human body approaches the sensor. The load imparted by the animate body may depend upon a distance between the animate body and sensor 300. For example, a capacitive load may increase with decreasing distance between the animate body and sensor 300.

The capacitance and/or inductance of sensor 304 may be sensed and/or monitored to determine if an animate body is proximate to sensor 300, such as described in examples further below.

Ground plane 304 may substantially shield sensor 300 from effects of an animate body in an area that extends outwardly from a surface 305 of ground plane 304, in a direction 308. In other words, patch-based proximity sensor 300 may be configured as a directional proximity sensor to sense an animate body proximate to a side or surface 303 of patch 303.

An apparatus and/or system may include a combination of one or more patch-based proximity sensors and one or more antennas. The one or more antennas may include one or more patch antennas and/or other type(s) of antennas.

Figure 4:
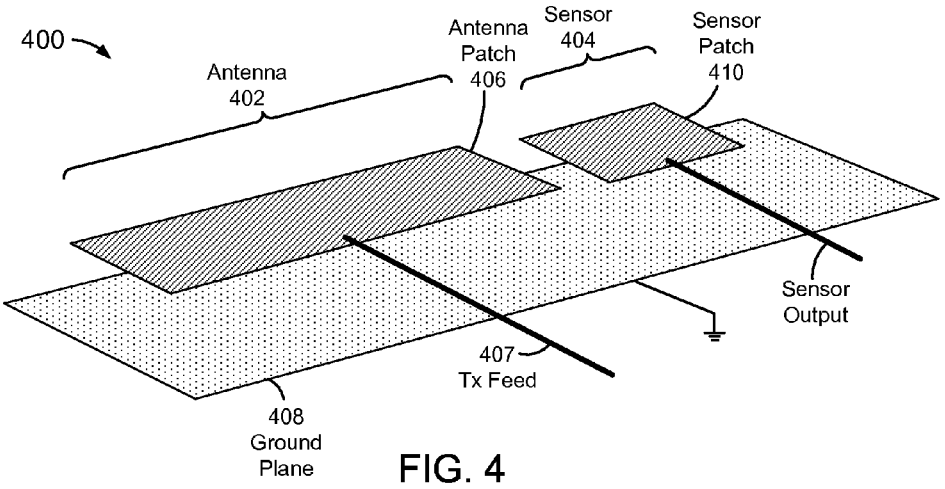
FIG. 4 is a perspective view of an apparatus that includes a patch antenna and a patch-based proximity sensor.

FIG. 4 is a perspective view of an antenna apparatus 400, including a patch antenna 402 and a patch-based proximity sensor 404.

Antenna 402 includes a patch 406 and a ground plane 408, to transmit a signal received over a feed 407 such as described above with reference to FIG. 1.

Proximity sensor 404 includes a patch 410 and ground plane 408, such as described above with reference to proximity sensor 300 in FIG. 3.

Patch 410 may be further configured as a directional proximity sensor to sense a proximate body within a radiation area, beam, or pattern of antenna 402, and to be substantially insensitive to an animate body outside of radiation area, beam, or pattern of antenna 402. Patch 410 may, for example, be in a same plane as patch 406.

Patches 406 and 410 may be positioned sufficiently proximate to one another, and/or otherwise configured, such that a distance between an animate body and a radiate side of patch 406 is substantially similar to a distance between the animate body and a corresponding side of sensor patch 410.

Antenna 402 may be selectively disabled if an animate body is determined to be proximate to sensor 404 and thus proximate to antenna 402.

Figure 5:
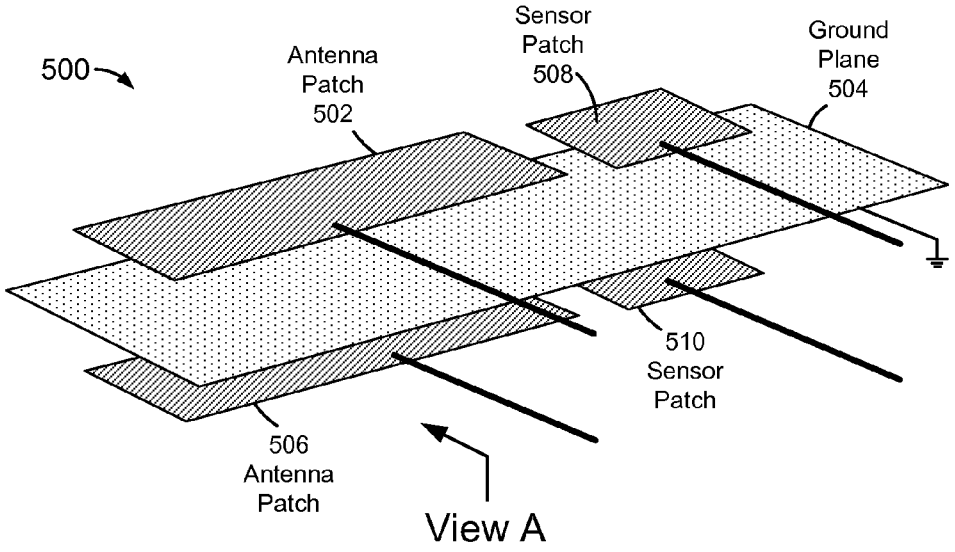
FIG. 5 is a perspective view of an apparatus that includes multiple patch antennas and patch-based proximity sensors.

FIG. 5 is a perspective view of an antenna apparatus 500, including multiple patch antennas and multiple patch-based proximity sensors.

A first antenna includes a first patch 502 and a ground plane 504. A second antenna includes a second patch 506 and ground plane 504. The first and second antennas may be configured as described above with respect to antennas 202 and 204 in FIG. 2.

A first proximity sensor includes a third patch 508 and ground plane 504. A second proximity sensor includes a fourth patch 510 and ground plane 504. The first and second proximity sensors may be configured as described above with respect to FIG. 3 and/or FIG. 4.

The first proximity sensor may be used to determine if an animate body is proximate to a radiate or transmit side of the first antenna, and the second proximity sensor may be used to determine if an animate body is proximate to a radiate or transmit side of the second antenna.

Alternatively, a combination of multiple proximity sensors may be used to determine if an animate body is proximate to a radiate or transmit side of the first antenna and/or the second antenna.

One or more antennas and/or one or more proximity sensors may be may be constructed, manufactured, fabricated, packaged, and/or otherwise implemented as described below with reference to FIG. 6.

Figure 6:
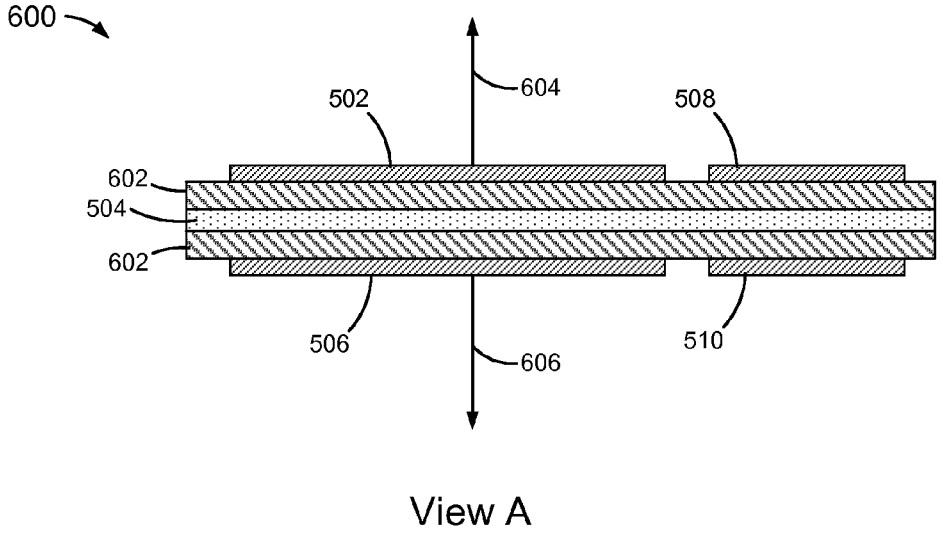
FIG. 6 is cross-sectional view of a module or package that includes multiple patch antennas and patch-based proximity sensors.

FIG. 6 is cross-sectional side-view of a package or module 600 (e.g., view A of FIG. 5), that includes multiple antennas and multiple proximity sensors. For illustrative purposes, features of module 600 are identified with respect to features of apparatus 500 in FIG. 5. Based on the disclosure herein, one skilled in the relevant art(s) will understand that one or more features of module 600 may be identified with respect to features of one or more other apparatuses and/or systems disclosed herein.

In the example of FIG. 6, patches 502 and 508 are in a first plane, patches 506 and 510 are in a second plane, and ground plane 504 is between and parallel with the first and second planes. A dielectric material 602 may be provided between ground plane 504 and patches 502 and 508, and between ground plane 504 and patches 506 and 510.

In the example of FIG. 6, the first antenna and the first proximity sensor are configured to radiate and sense substantially in a direction 604, and the second antenna and the second proximity sensor are configured to radiate and sense substantially in a direction 606.

Module 600 may be manufactured, constructed, or fabricated with a multi-layer printed circuit board (PCB) technique, and may be configured as a stand-alone multi-layer device or may be and/or provided on a multi-layer PCB with one or more other devices, systems, and/or circuitry.

Figure 7:
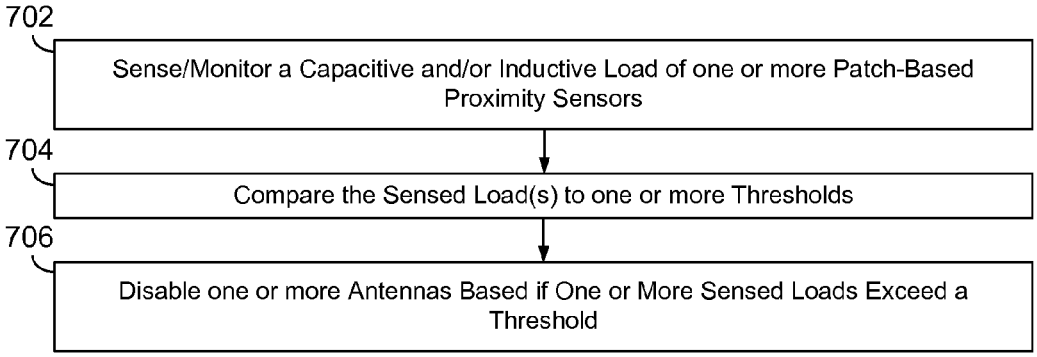
FIG. 7 is a flowchart of a method of controlling one or more antennas based on a proximity of an animate body to one or more patch-based proximity sensors.

FIG. 7 is a flowchart of a method 700 of controlling one or more antennas based on a proximity of an animate body to one or more patch-based proximity sensors.

At 702, a load of each of one or more patch-based proximity sensors is monitored. The monitoring may include monitoring a capacitive and/or electrical load.

At 702, the one or more sensed loads are compared to one or more thresholds. The threshold may correspond to a maximum permitted amount of radiation to an animate body is to be exposed, and/or a minimum distance permitted between an animate body and a transmitting antenna, such as described in one or more examples further below.

At 704, one or more antennas are disabled if one or more sensed loads exceed a threshold. The disabling may include re-routing a transmit signal from a first set of one or more antennas to a second set of one or more antennas. The one or more antennas may include one or more of a variety of antenna types, including but not limited to patch antennas.

Systems to control one or more antennas based on a proximity of an animate body to one or more patch-based proximity sensors are provided below.

Figure 8:
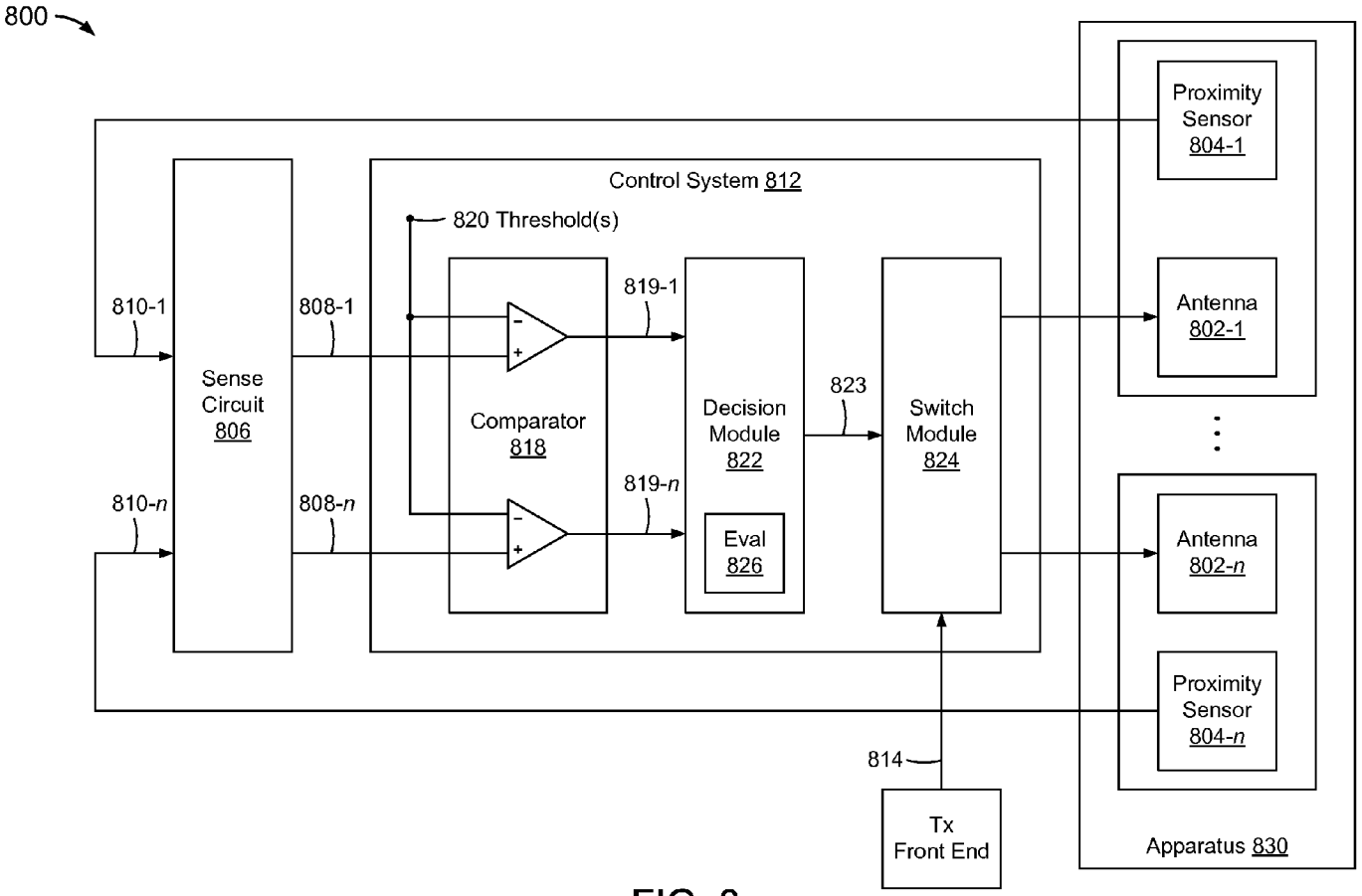
FIG. 8 is a block diagram of a communication system, including a control system to control one or more antennas based on one or more measures of proximity.

FIG. 8 is a block diagram of a communication system 800, including a control system 812 to control one or more antennas based on one or more measures of proximity. Antenna control may include selectively enabling and/or disabling an antenna, and/or selective routing one or more transmit signals amongst multiple antennas.

System 800 includes an antenna/sensor apparatus 830, which may include multiple antennas 802 and multiple patch-based proximity sensors 804, one or more of which may be implemented as described in one or more examples herein. Each proximity sensor 804 may be positioned proximate to a corresponding one of antennas 802, such as described above with respect to FIG. 4.

System 800 further includes a sense circuit 806 to determine proximity measures 808 for proximity sensors 804. Sense circuit 806 may include one or more capacitive and/or inductive sense circuits to sense capacitive and/or inductive loads of proximity sensors 804.

System 800 further includes a control system 812 to selectively apportion or route one or more transmit signals 814 amongst antennas 802 based on one or more of proximity measures 808.

In the example of FIG. 8, control system 812 includes a comparator 818 to compare proximity measures 808 to one or more thresholds 820, and a decision module 822 to selectively enable and/or disable one or more of antennas 802 based on one or more of the comparisons. Threshold(s) 820 are described further below.

An antenna 802 may be enabled by providing a transmit signal 814 to the antenna. Conversely, an antenna 802 may be disabled by re-routing or otherwise precluding transmit signal 814 from reaching the antenna.

A decision to enable or disable a particular antenna 802 may be based on a proximity measure of an associated proximity sensor 804, and/or based on a proximity measure of one or more other proximity sensors 804.

In an embodiment, control system 812 is configured to disable antenna 802-1 if proximity measure 808-1 of proximity sensor 804-1 exceeds a threshold 820. Control system 812 may be further configured to disable another one of antennas 802 if proximity measure 808 of an associated proximity sensor exceeds a threshold 820.

A threshold 820 may correspond to a distance between an animate body and a radiating antenna, at which the animate body is exposed to a maximum permitted or maximum desired amount of EM radiation. A threshold 820 or minimum distance may be based on a maximum permitted SAR as specified in a guideline, a standard, a statute, and/or a rule, promulgated by an entity such as a government.

For example, and without limitation, one or more thresholds 820 may correspond to distance(s) from an antenna at which an animate body is exposed to:

- a SAR of 0.08 W/kg, as averaged over the animate body;
- a spatial peak SAR not exceeding 1.6 W/kg, averaged over a 1 gram cube of tissue of the animate body; and/or
- a special peak SAR in an extremity of the animate body not exceeding 4 W/kg, averaged over a 10 gram cube of the extremity.

A distance at which an animate body is exposed to a particular measure of radiation may depend upon one or more antenna configuration parameters (e.g., antenna dimensions) and/or operational parameters (e.g., transmit power level). A threshold 820 may be tailored or calibrated to accommodate variations in such parameters.

A threshold 820 may represent a measure of capacitance and/or inductance that corresponds to a maximum permitted SAR and/or a minimum permitted distance. A capacitive threshold may be, for example, approximately equal to 100 femto Farads (fF), and/or within a range that includes 100 femto Farads (fF) and that correspond to a distance of several millimeters (mm) or centimeters (cm) between an animate body and a proximity sensor.

Comparator 818 may output a comparison result 819 for each proximity sensor 804, and/or for each of one or more sets of multiple proximity sensors 804.

Decision module 822 outputs one or more controls 823 to route and/or re-route a transmit signal 814 to one or more of antennas 802 based one or more comparison results 819.

Decision module 822 may include an evaluation module 826 to evaluate a stream of comparison results 819 for each of one or more proximity sensors 804. Evaluation module 826 may include one or more of a filter, an averager, and an integrator. Decision module 822 may be configured to selectively enable and/or disable one or more of antennas 802 based on evaluation results of a stream of comparison results. This may help to avoid disabling of an antenna due to spurious conditions.

Decision module 822 may be configured to provide transmit signal 814 to each of multiple antennas 802 by default, and to selectively decouple transmit signal 814 from individual ones of antennas 802 if an associated proximity measure 808 exceeds a threshold 820. Alternatively, decision module 822 may be configured to provide transmit signal 814 to a first set of one or more of antennas 802 by default, and to re-route transmit signal 814 to one or more other sets of one or more antennas 802 if a proximity measure(s) 808 associated with the first set of antennas 802 exceeds a threshold 820. Decision module 822 is not, however, limited to these examples.

In FIG. 8, control system 812 includes a switch module 824 to route and/or re-route transmit signal(s) 814 amongst antennas 802 based on one or more controls 823 from decision module 822. Switch module 824 may include an RF switch.

Switch module 824 may include a single-pole, multiple-throw (SPMT) switch to provide transmit signal 814 to one of multiple selectable sets of antennas 802, where each subset includes one or more antennas 802. The SPMT may include a single-pole, double-throw (SPDT) switch to switch transmit signal 814 between one of two sets of antennas 802.

Methods and systems disclosed herein may be implemented in hardware, firmware, a computer system, a machine, and combinations thereof, including discrete and integrated circuitry, application specific integrated circuits (ASICs), and/or microcontrollers, and may be implemented as part of a domain-specific integrated circuit package or system-on-a-chip (SOC), and/or a combination of integrated circuit packages.

Figure 9:
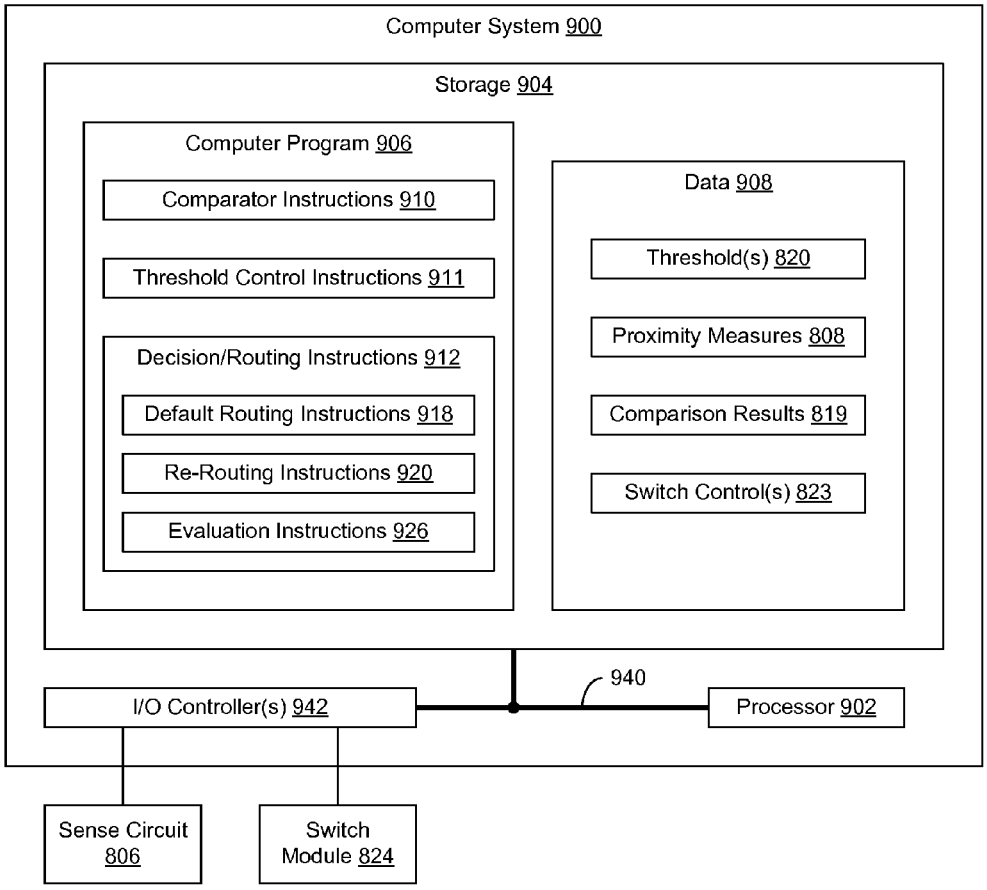
FIG. 9 is a block diagram of a computer system to selectively control one or more antennas based on one or more measures of proximity.

FIG. 9 is a block diagram of a computer system 900, configured to selectively control one or more antennas based on one or more measures of proximity.

Computer system 900 is described below with reference to system 800 in FIG. 8. Computer system 900 is not, however, limited to the example of FIG. 8.

Computer system 900 includes one or more computer instruction processor units and/or processor cores, illustrated here as a processor 902, to execute computer readable instructions of a computer program, also referred to as computer program logic, which may be encoded within a computer readable medium, which may include a non-transitory medium. Processor 902 may include a general purpose instruction processor, a controller, a microcontroller, or other instruction-based processor.

Computer system 900 further includes storage 904, which may include one or more types of storage described below with reference to FIG. 10.

Figure 10:
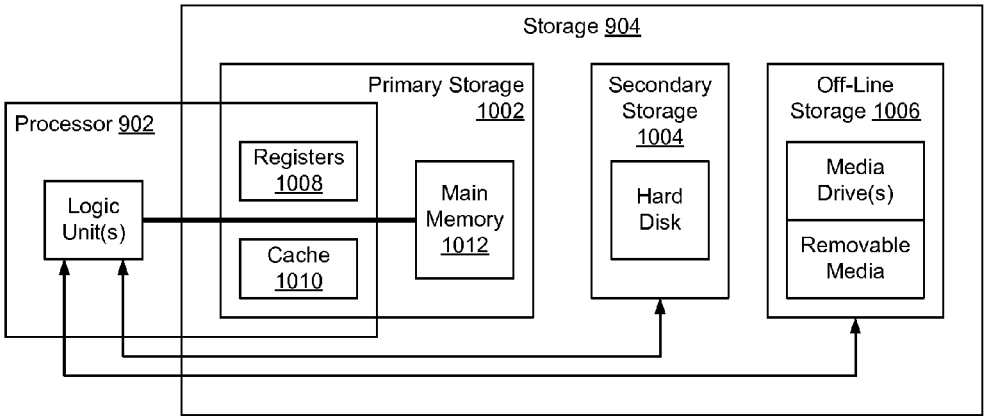
FIG. 10 is a block diagram of processor and storage of FIG. 9, where the storage includes primary storage, secondary storage, and off-line storage.

FIG. 10 is a block diagram of processor 902 and storage 904, where storage 904 includes primary storage 1002, secondary storage 1004, and off-line storage 1006.

Primary storage 1002 includes registers 1008, processor cache 1010, and main memory or system memory 1006. Registers 1008 and cache 1010 may be directly accessible by processor 902. Main memory 1006 may be accessible to processor 902 directly and/or indirectly through a memory bus. Primary storage 1002 may include volatile memory such as random-access memory (RAM) and variations thereof including, without limitation, static RAM (SRAM) and/or dynamic RAM (DRAM).

Secondary storage 1004 may be indirectly accessible to processor 902 through an input/output (I/O) channel, and may include non-volatile memory such as read-only memory (ROM) and variations thereof including, without limitation, programmable ROM (PROM), erasable PROM (EPROM), and electrically erasable PROM (EEPROM). Non-volatile memory may also include non-volatile RAM (NVRAM) such as flash memory. Secondary storage 1004 may be configured as a mass storage device, such as a hard disk or hard drive, a flash memory drive, stick, or key, a floppy disk, and/or a zip drive.

Off-line storage 1006 may include physical driver device and an associated removable storage medium, such as an optical disc.

In FIG. 9, storage 904 includes data 908 to be used by processor 902 during execution of a computer program, and/or generated by processor 902 during execution of a computer program.

Storage 904 further includes a computer program 906 to cause processor 902 to selectively route one or more transmit signals to one or more antennas. Computer program 906 may represent an example implementation of control system 812 in FIG. 8, or a portion thereof.

In FIG. 9, computer program 906 includes comparator instructions 910 to cause processor 902 to compare proximity measures 808 with one or more thresholds 820, and to provide corresponding comparison results 819, such as described above with reference to FIG. 8. Alternatively, comparisons may be performed in hardware circuitry.

Computer program 906 may include threshold control instructions 911 to cause processor 902 to set one or more thresholds 820, such as in response to user input.

Computer program 906 further includes decision/routing instructions 912 to cause processor 902 to generate one or more switch controls 823 based on comparison results 819, such as described above with respect to FIG. 8.

In FIG. 9, decision/routing instructions 912 include default routing instructions 918 to cause processor 902 to set switch control(s) 823 to a default value(s), to route a transmit signal to one or more default antennas, such as described with respect to one or more examples above.

Decision/routing instructions 912 further include re-routing instructions 920 to cause processor 902 to alter or revise switch control(s) 723, to re-route the transmit signal to one or more other antennas if an animate body is proximate to, or with a radiation pattern of the default antenna(s).

Decision/routing instructions 912 may further include evaluation instructions 926 to cause processor 902 to evaluate a stream of comparison results 819, such as described above with respect to evaluation module 826 in FIG. 8.

Computer system 900 may include communications infrastructure 940 to communicate amongst devices and/or resources of computer system 900.

Computer system 900 may include one or more input/output (I/O) controllers 942 to communicate with one or more other systems, such as to receive proximity measures 808 from sense circuit 806 and to provide switch control(s) 823 to switch module 824.

Methods and systems disclosed herein may be implemented with respect to one or more of a variety of systems, such as described below with reference to FIGS. 11 through 13. Methods and systems disclosed herein are not, however, limited to the examples of FIGS. 11 through 13.

Figure 11:
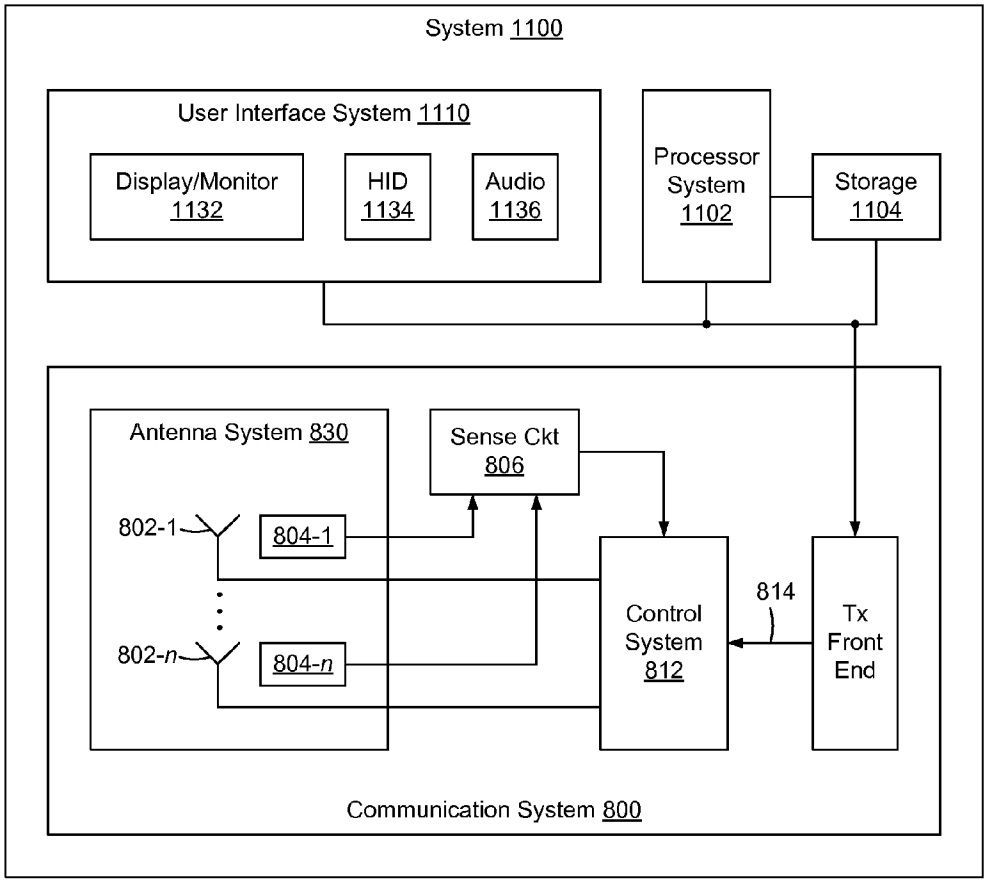
FIG. 11 is a block diagram of a system, including the communication system of FIG. 8 to interface between a wireless network and one or more of a processor system and a user interface system.

FIG. 11 is a block diagram of a system 1100, including communication system 800 of FIG. 8 to interface between a wireless network and one or more of a processor system 1102 and a user interface system 1110. The wireless communication network may include, without limitation, a wireless wide area network (WWAN).

System 1100 may include storage 1104, which may include one or more features described above with respect to FIG. 10. Storage 1104 may be accessible to one or more of processor system 1102, communication system 800, and user interface system 1110.

User interface system 1110 may include a monitor or display 1132 and/or a human interface device (HID) 1134. HID 1134 may include, without limitation, a key board, a cursor device, a touch-sensitive device, a motion and/or image sensor, a physical device and/or a virtual device, such as a monitor-displayed virtual keyboard. User interface system 1110 may include an audio system 1136, which may include a microphone and/or a speaker.

System 1100 may correspond to, for example, a computer system and/or a communication device and may include a housing such as, without limitation, a rack-mountable housing, a desk-top housing, a lap-top housing, a notebook housing, a net-book housing, a tablet housing, a telephone housing, a set-top box housing, and/or other conventional housing and/or future-developed housing. Communication system 800, processor system 1102, storage 1104, and user interface system 1110, or portions thereof, may be positioned within the housing, such as described below with reference to FIGS. 12 and 13.

System 1100 or portions thereof may be implemented within one or more integrated circuit dies, and may be implemented as a system-on-a-chip (SoC).

Figure 12:
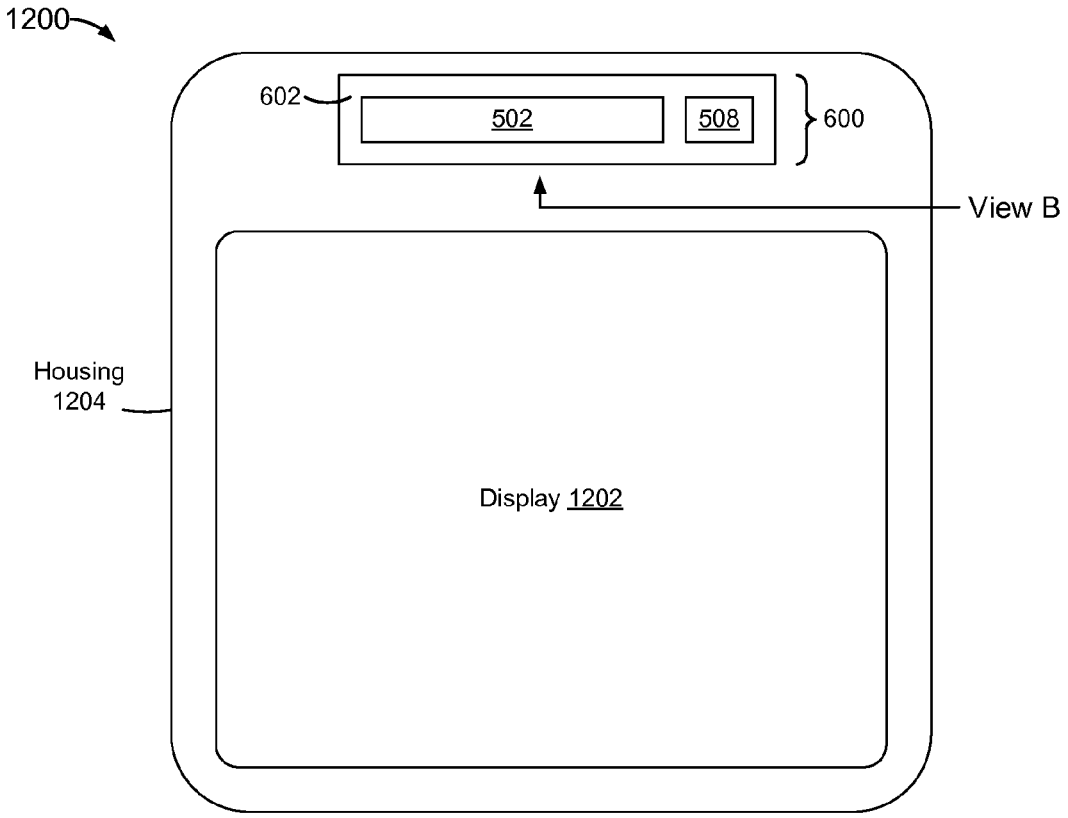
FIG. 12 is an illustration of a system, including a display and the module of FIG. 6 within a housing.

FIG. 12 is an illustration of a system 1200, including a display 1202 and antenna/sensor module 600 of FIG. 6 within a housing 1204. System 1200 may further include a processor and/or memory, such as described in one or more examples herein. System 1200 may represent a tablet-type computer system or a portable telephone (cellular or satellite based). System 1200 is not, however, limited to these examples.

Figure 13:
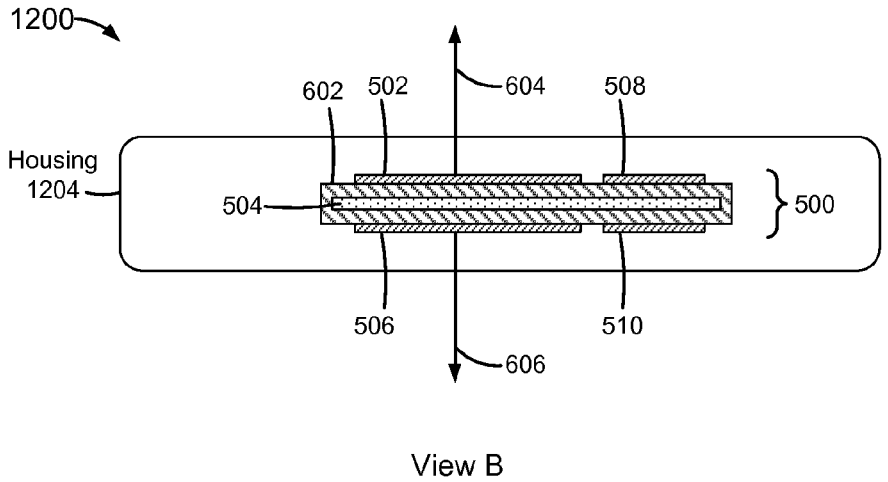
FIG. 13 is cross-section view of the system of FIG. 12.

FIG. 13 is cross-section view of system 1200 (view B of FIG. 12).

In FIGS. 12 and 13, module 600 is configured to cause the first antenna to radiate antenna outwardly in direction 604, which may correspond to a direction in which display 1202 radiates. Module 600 is further configured to cause the second antenna to radiate outwardly in direction 606 (e.g., to outwardly through a rear surface of housing 1204). Alternatively, module 600 may be configured to cause the first and second antennas radiate in other directions, and/or may include one or more additional modules 600 configured to radiate in one or more other directions.

System 1200 may further include a transmitter front-end to provide one or more transmit signals, and a control system to selectively provide the transmit signal(s) to one or more of the first and second antennas of module 600, such as described in one or more examples herein.

Further to the disclosure and examples above, a method of controlling an antenna may include comparing a first sensed value to a threshold and selectively disabling a first antenna based at least in part on the comparison.

The sensed value may represent one or more of a capacitance and an inductance indicative of a proximity of an animate body to a first proximity sensor.

The threshold may correspond to a minimum permitted proximity to protect an animate body from exposure to more than a pre-determined amount of electromagnetic (EM) energy from the first antenna and/or to protect the first antenna from adverse effects of the animate body.

The threshold may correspond to a proximity at which the animate body is subjected to one or more of a specific absorption rate (SAR) of no more than 0.08 W/kg, averaged over the animate body, a spatial peak SAR of no more than 1.6 W/kg, averaged over a 1 gram cube of tissue of the animate body, and a spatial peak SAR in an extremity of the animate body of no more than 4 W/kg, averaged over a 10 gram cube of the extremity.

The method may include re-routing a transmit signal from the first antenna to a second antenna if the sensed load value exceeds the threshold.

The method may include providing a transmit signal to the first antenna and re-routing the transmit signal from the first antenna to a second antenna if the first sensed value exceeds the threshold.

The method may include providing a transmit signal to each of first and second antennas, comparing the first sensed value and a second sensed value to the threshold, where the second sensed value represents one or more of a capacitance and an inductance indicative of a proximity of an animate body to a second proximity sensor, disabling the first antenna if the first sensed value exceeds the threshold, and disabling a second antenna if the second sensed value exceeds the threshold.

The method may include comparing multiple sensed values from multiple proximity sensors to the threshold, and disabling the first antenna based on a combination of the comparisons. Each of the multiple sensed values may be compared to one of multiple thresholds.

The method may include comparing the first sensed value to one or more of multiple thresholds.

The method may include comparing a stream of sensed values associated with the first proximity sensor to the threshold, evaluating a corresponding stream of comparison results, and selectively disabling the first antenna based at least in part on results of the evaluating. The evaluating may include one or more of filtering, averaging, and integrating.

A control system may be configured to perform a method as described above.

A control system may include a comparator to compare a first sensed value to a threshold, where the first sensed value represents one or more of a capacitance and an inductance indicative of a proximity of an animate body to a first proximity sensor. The control system may further include a decision module to selectively disable a first antenna based at least in part on the comparison.

The threshold may correspond to a minimum permitted proximity such as described further above.

The control system may be configured to provide a transmit signal to the first antenna and re-route the transmit signal from the first antenna to a second antenna if the first sensed value exceeds the threshold.

The control system may be configured to provide a transmit signal to each of first and second antennas. The comparator may be configured to compare the first sensed value and a second sensed value to the threshold, where the second sensed value represents one or more of a capacitance and an inductance indicative of a proximity of an animate body to a second proximity sensor. The decision system may be further configured to disable the first antenna if the first sensed value exceeds the threshold, and disable a second antenna if the second sensed value exceeds the threshold.

The comparator may be configured to compare multiple sensed values from multiple proximity sensors to the threshold, and the decision module may be implemented to disable the first antenna based on a combination of the comparisons. The comparator may be configured to each of the sensed values to one of multiple thresholds.

The comparator may be configured to compare the first sensed value to one or more of multiple thresholds.

The comparator may be configured to compare a stream of sensed values associated with the first proximity sensor to the threshold, and the decision module may include an evaluator module to evaluate a corresponding stream of comparison results and selectively disable the first antenna based at least in part on results of the evaluating. The evaluator module may include one or more of a filter, an averager, and an integrator.

A non-transitory computer readable medium may be encoded with a computer program, including instructions to cause a processor to perform a method as described above.

A non-transitory computer readable medium may be encoded with a computer program, including instructions to cause a processor to compare a first sensed value to a threshold and selectively disable a first antenna based at least in part on the comparison.

The sensed value may represent one or more of a capacitance and an inductance indicative of a proximity of an animate body to a first proximity sensor.

The threshold may correspond to a minimum permitted proximity such as described further above.

The instructions may include instructions to cause the processor to provide a transmit signal to each of first and second antennas, compare the first sensed value and a second sensed value to the threshold, where the second sensed value represents one or more of a capacitance and an inductance indicative of a proximity of an animate body to a second proximity sensor, disable the first antenna if the first sensed value exceeds the threshold, and disable a second antenna if the second sensed value exceeds the threshold.

The instructions may include instructions to cause the processor to compare multiple sensed values from multiple proximity sensors to the threshold, and disable the first antenna based on a combination of the comparisons. Each of the multiple sensed values may be compared to one of multiple thresholds.

The instructions may include instructions to cause the processor to compare the first sensed value to one or more of multiple thresholds.

The instructions may include instructions to cause the processor to compare a stream of sensed values associated with the first proximity sensor to the threshold, evaluate a corresponding stream of comparison results, and selectively disable the first antenna based at least in part on results of the evaluation. Evaluation instructions may include instructions to cause the processor to filter, average, and/or integrate.

A machine readable storage medium may include program code that, when executed, causes a machine to perform a method as described above.

A machine readable storage medium may include program code that, when executed, causes a machine to compare a first sensed value to a threshold and selectively disable a first antenna based at least in part on the comparison.

The sensed value may represent one or more of a capacitance and an inductance indicative of a proximity of an animate body to a first proximity sensor.

The threshold may correspond to a minimum permitted proximity such as described further above.

The program code may include instructions that, when executed, causes the machine to provide a transmit signal to each of first and second antennas, compare the first sensed value and a second sensed value to the threshold, where the second sensed value represents one or more of a capacitance and an inductance indicative of a proximity of an animate body to a second proximity sensor, disable the first antenna if the first sensed value exceeds the threshold, and disable a second antenna if the second sensed value exceeds the threshold.

The program code may include instructions that, when executed, causes the machine to compare multiple sensed values from multiple proximity sensors to the threshold, and disable the first antenna based on a combination of the comparisons. Each of the multiple sensed values may be compared to one of multiple thresholds.

The program code may include instructions that, when executed, causes the machine to compare the first sensed value to one or more of multiple thresholds.

The program code may include instructions that, when executed, causes the machine to compare a stream of sensed values associated with the first proximity sensor to the threshold, evaluate a corresponding stream of comparison results, and selectively disable the first antenna based at least in part on results of the evaluation. Evaluation instructions may include instructions, when executed, causes the machine to filter, average, and/or integrate.

An apparatus may include a first antenna to radiate radio frequency (RF) electromagnetic energy (EM) from a first side of the first antenna, and a first proximity sensor to indicate a proximity of an animate body to the first side of the first antenna.

The first proximity sensor may include a first electrically conductive patch, a ground plane, and a dielectric material between the first electrically conductive patch and the ground plane.

The first proximity sensor may include one or more of a capacitance and an inductance configured to vary based on the proximity of the animate body to the first side of the first antenna.

The first antenna may include a second electrically conductive patch, the ground plane, and the dielectric material between the second patch and the ground plane.

The first and second patches may be in a first plane that is parallel to the ground plane.

The ground plane may be configured to substantially shield an animate body on a second side of the first antenna from electromagnetic (EM) energy radiated from the first side of the first antenna.

The first antenna may be configured to impart a peak specific absorption rate (SAR) of no more than 0.27 Watt/kilogram to an animate body on the second side of the first antenna when the first antenna transmits at a power level of 1 Watt.

The ground plane may be configured to substantially shield the first antenna and the first proximity sensor from effects of an animate body on a second side of the first antenna.

A surface area of the ground plane may be greater than a surface area occupied by a combination of the first and second patches.

An apparatus as described above may further include a sense circuit to sense one or more of a capacitance and an inductance of the first proximity sensor and provide a corresponding sensed value, and a control system to compare the sensed value to a threshold and selectively disable the first antenna based at least in part on the comparison, such as described in one or more examples above.

The threshold may correspond to a minimum permitted proximity such as described further above.

An apparatus as described above may further include a second antenna to radiate radio frequency (RF) electromagnetic energy (EM) from a first side of the second antenna, and a second proximity sensor to indicate a proximity of an animate body to the first side of the second antenna.

The second may include a third patch, the ground plane, and the dielectric material between the third electrically conductive patch and the ground plane.

The second proximity sensor may include a fourth electrically conductive patch, the ground plane, and the dielectric material between the fourth electrically conductive patch and the ground plane.

The third and fourth patches may be in a second plane that is parallel with the first plane and the ground plane, and the ground plane may be between the first and second planes.

The first and second antennas may be configured to provide a combined radiation pattern that is substantially isotropic.

A communication system may include a processor system and memory, a user interface system to interface with the processor system, and a communication system to interface between a wireless network and one or more of the processor and the user interface system. The communication system may include a sensor and antenna apparatus, a sense circuit, and a control system, as recited in one or more examples above. The communication system may be configured as a portable telephone. The communication system may be configured as a portable computer system.

A patch-based proximity sensor may include an electrically conductive patch in a first plane, a ground plane parallel with the first plane, and a dielectric material between the electrically conductive patch and the ground plane. The proximity sensor may further include one or more of a capacitance and an inductance configured to vary based on a proximity of an animate body to proximity sensor.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed.

While various embodiments are disclosed herein, it should be understood that they are presented as examples. The scope of the claims should not be limited by any of the example embodiments disclosed herein.

What is claimed is:

1. An apparatus, comprising:

a ground plane;

a first dielectric layer disposed over a first surface of the ground plane;

a first electrically conductive patch disposed over a first portion of the first dielectric layer and configured as a first directional antenna; and a second electrically conductive patch disposed over a second portion of the surface of the first dielectric layer and configured as a first directional proximity sensor that is sensitive to animate bodies within a radiation area of the first directional antenna.

2. The apparatus of claim 1, wherein one or more of a capacitance and an inductance of the first proximity sensor is sensitive to animate bodies within the radiation area of the first antenna.

3. The apparatus of claim 1, wherein the first and second patches are in a first plane that is parallel to the ground plane.

4. The apparatus of claim 3, wherein the ground plane is configured to shield animate bodies proximate to the second surface of the ground plane from electromagnetic energy radiated from the first directional antenna.

5. The apparatus of claim 4, wherein the first directional antenna is configured to impart a peak specific absorption rate (SAR) of no more than 0.27 Watt/kilogram to an animate body proximate to a second surface of the ground plane when the first directional antenna transmits at a power level of 1 Watt.

6. The apparatus of claim 5, wherein the ground plane is further configured to shield the first directional antenna and the first directional proximity sensor from effects of an animate body proximate to the second surface of the ground plane.

7. The apparatus of claim 5, wherein a surface area of the ground plane is greater than a sum of surface areas of the first and second electrically conductive patches.

8. The apparatus of claim 1, further including:

sense circuitry configured to determine a proximity measure based on a load of the first directional proximity sensor; and a control system configured to disable the first directional antenna if the proximity measure exceeds a first threshold.

9. The apparatus of claim 8, wherein the threshold corresponds to a minimum permitted proximity to protect the animate body from exposure to more than a pre-determined amount of electromagnetic (EM) energy from the first directional antenna.

10. The apparatus of claim 8, wherein the threshold corresponds to a proximity at which an animate body is subjected to one or more of, a specific absorption rate (SAR) of no more than 0.08 W/kg, averaged over the animate body, a spatial peak SAR of no more than 1.6 W/kg, averaged over a 1 gram cube of tissue of the animate body, and a special peak SAR in an extremity of the animate body of no more than 4 W/kg, averaged over a 10 gram cube of the extremity.

11. The apparatus of claim 1, further including:

a second layer of dielectric material disposed over a second surface of the ground plane;

a third electrically conductive patch disposed over a first portion of the second dielectric layer and configured as a second directional antenna; and a fourth electrically conductive patch disposed over a second portion of the surface of the second dielectric layer and configured as a second directional proximity sensor that is sensitive to animate bodies within a radiation area of the second directional antenna;

wherein the first and second electrically conductive patches are in a first plane that is parallel to the ground plane; and wherein the third and fourth electrically conductive patches are in a second plane that is parallel with the first plane and the ground plane.

12. The apparatus of claim 11, wherein the first and second directional antennas are configured to provide a combined radiation pattern that is substantially isotropic.

* * * * *